US009868609B2

(12) United States Patent
Awano et al.

(10) Patent No.: US 9,868,609 B2
(45) Date of Patent: Jan. 16, 2018

(54) SHEET PROCESSING APPARATUS, IMAGE FORMING SYSTEM, AND PAIR OF PRESSING MEMBERS

(71) Applicant: FUJI XEROX CO., LTD., Tokyo (JP)

(72) Inventors: Hiroaki Awano, Kanagawa (JP); Hiroaki Mogi, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 236 days.

(21) Appl. No.: 14/695,898

(22) Filed: Apr. 24, 2015

(65) Prior Publication Data

US 2016/0096702 A1 Apr. 7, 2016

(30) Foreign Application Priority Data

Oct. 2, 2014 (JP) ..... 2014-203875

(51) Int. Cl.

| | |
|---|---|
| ***B65H 45/18*** | (2006.01) |
| ***B31F 1/00*** | (2006.01) |
| ***B65H 45/04*** | (2006.01) |
| *B65H 45/12* | (2006.01) |

(52) U.S. Cl.

CPC ..... *B65H 45/18* (2013.01); *B31F 1/0003* (2013.01); *B31F 1/0006* (2013.01); *B31F 1/0035* (2013.01); *B65H 45/04* (2013.01); *B65H 45/12* (2013.01); *B65H 2301/51232* (2013.01); *B65H 2701/13212* (2013.01); *B65H 2801/27* (2013.01)

(58) Field of Classification Search

CPC ..... B65H 45/04; B65H 45/12; B65H 2701/13212; B65H 2301/51232; B31F 1/0003; B31F 1/0006; B31F 1/0035

USPC ..... 270/32, 45, 58.07, 58.08

See application file for complete search history.

(56) References Cited

U.S. PATENT DOCUMENTS

| | | | | |
|---|---|---|---|---|
| 7,740,238 | B2 * | 6/2010 | Iijima | B42B 4/00 270/32 |
| 7,770,876 | B2 * | 8/2010 | Sasahara | B31F 1/08 270/20.1 |
| 7,954,797 | B2 * | 6/2011 | Sasahara | B31F 1/08 270/45 |
| 8,091,877 | B2 * | 1/2012 | Iguchi | B65H 37/04 270/32 |

(Continued)

FOREIGN PATENT DOCUMENTS

| | | |
|---|---|---|
| JP | 2004-059304 A | 2/2004 |
| JP | 2007-045531 A | 2/2007 |

(Continued)

OTHER PUBLICATIONS

Communication dated Jul. 3, 2017, issued by the State Intellectual Property Office in counterpart application No. 201510309499.9.

*Primary Examiner* — Leslie A Nicholson, III
(74) *Attorney, Agent, or Firm* — Sughrue Mion, PLLC

(57) ABSTRACT

A sheet processing apparatus includes a pressing unit and a shifting unit. The pressing unit has a protrusion and presses the protrusion against a fold section of a sheet. The fold section extends in one direction. The shifting unit moves at least one of the protrusion of the pressing unit and the sheet so as to shift a pressing position, at which the fold section is pressed by the protrusion, in the one direction or in a direction opposite to the one direction.

12 Claims, 12 Drawing Sheets

(56) References Cited

U.S. PATENT DOCUMENTS

| | | | | |
|---|---|---|---|---|
| 8,333,372 | B2 * | 12/2012 | Awaya | B65H 37/04 270/58.07 |
| 8,353,504 | B2 | 1/2013 | Hattori et al. | |
| 8,424,859 | B2 * | 4/2013 | Ishikawa | B31F 1/08 270/32 |
| 8,500,111 | B2 * | 8/2013 | Terao | B65H 45/18 270/32 |
| 2011/0241274 | A1 * | 10/2011 | Iijima | B65H 45/18 270/37 |
| 2014/0030000 | A1 * | 1/2014 | Gamo | G03G 15/6582 399/408 |
| 2014/0161565 | A1 * | 6/2014 | Obuchi | B42C 5/00 412/33 |

FOREIGN PATENT DOCUMENTS

| | | | |
|---|---|---|---|
| JP | 2011201698 | A * | 10/2011 |
| JP | 2011-251811 | A | 12/2011 |

* cited by examiner

SHEET PROCESSING APPARATUS, IMAGE FORMING SYSTEM, AND PAIR OF PRESSING MEMBERS

CROSS-REFERENCE TO RELATED APPLICATIONS

This application is based on and claims priority under 35 USC 119 from Japanese Patent Application No. 2014-203875 filed Oct. 2, 2014.

BACKGROUND

Technical Field

The present invention relates to sheet processing apparatuses, image forming systems, and pairs of pressing members.

Summary

According to an aspect of the invention, there is provided a sheet processing apparatus including a pressing unit and a shifting unit. The pressing unit has a protrusion and presses the protrusion against a fold section of a sheet. The fold section extends in one direction. The shifting unit moves at least one of the protrusion of the pressing unit and the sheet so as to shift a pressing position, at which the fold section is pressed by the protrusion, in the one direction or in a direction opposite to the one direction.

BRIEF DESCRIPTION OF THE DRAWINGS

An exemplary embodiment of the present invention will be described in detail based on the following figures, wherein.

DETAILED DESCRIPTION

An exemplary embodiment of the present invention will be described below with reference to the appended drawings.

Image Forming System 100

Figure 1:
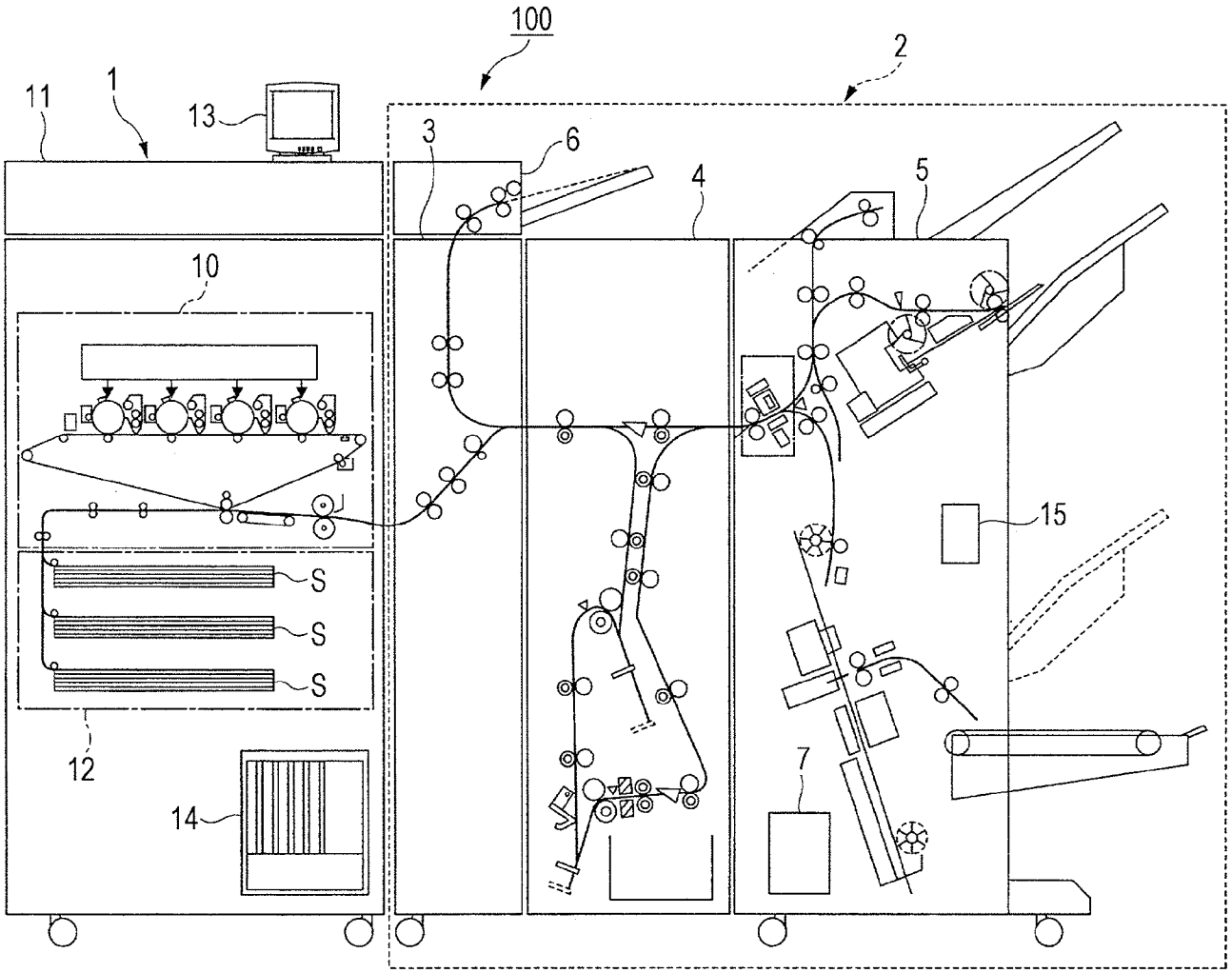
FIG. 1 illustrates the overall configuration of an image forming system according to an exemplary embodiment.

FIG. 1 illustrates the overall configuration of an image forming system 100 according to an exemplary embodiment. The image forming system 100 shown in FIG. 1 is provided with an image forming apparatus 1 that forms a color image by electrophotography, such as a printer or a copier, and a post-processing apparatus 2 that performs post-processing on a sheet S having an image formed thereon by the image forming apparatus 1.

The image forming apparatus 1 includes an image forming unit 10 that forms images based on image data of respective colors, an image reading unit 11 that reads an image from a document so as to generate read image data, a sheet feeding unit 12 that feeds a sheet S to the image forming unit 10, an overall user interface 13 that accepts an operation input from a user and presents information to the user, and a controller 14 that controls the overall operation of the image forming system 100.

The post-processing apparatus 2 is provided with a transport unit 3 that receives and transports a sheet S having an image formed thereon from the image forming apparatus 1, a folding unit 4 that performs a folding process on the sheet S transported from the transport unit 3, a finisher unit 5 that performs a finishing process on the sheet S that has passed through the folding unit 4, and an interposer 6 that feeds a slip sheet to be used as, for example, a cover of a booklet.

Furthermore, the post-processing apparatus 2 is provided with a sheet processing controller 7 that controls each functional unit of the post-processing apparatus 2, and a user interface (UI) 15 that accepts a post-processing-related operation input from a user.

Although this exemplary embodiment shows a configuration example in which the sheet processing controller 7 is provided within the post-processing apparatus 2, the sheet processing controller 7 may alternatively be provided within the image forming apparatus 1. Moreover, the controller 14 may alternatively have the control function of the sheet processing controller 7.

Furthermore, although this exemplary embodiment shows a configuration example in which the user interface 15 is provided in the post-processing apparatus 2, the user interface 15 may alternatively be provided in the image forming apparatus 1. Moreover, the overall user interface 13 may have the function of the user interface 15.

Post-Processing Apparatus 2

Figure 2:
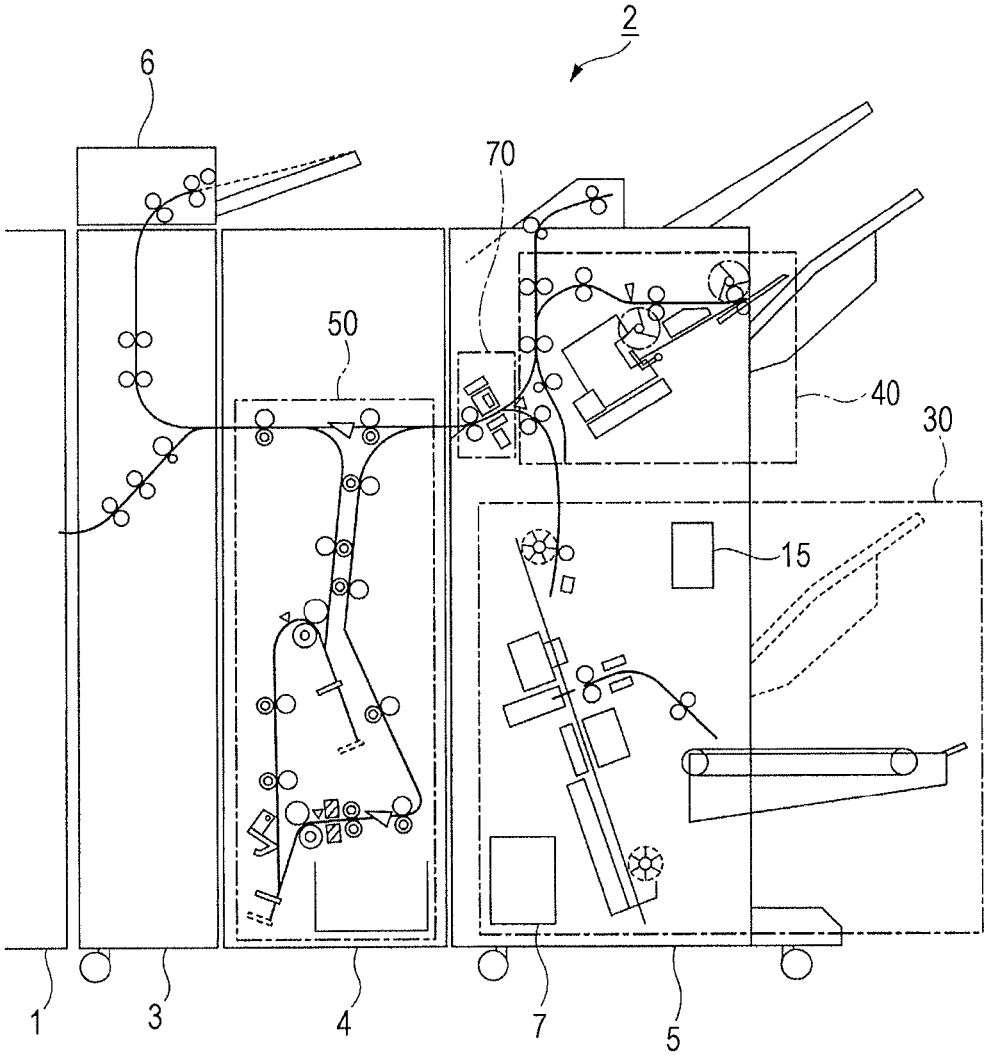
FIG. 2 illustrates a post-processing apparatus.

FIG. 2 illustrates the post-processing apparatus 2.

The post-processing apparatus 2 is provided with the finisher unit 5. The finisher unit 5 is provided with a punching functional unit 70 that performs a punching process on a sheet S so as to form, for example, two holes or four holes therein, and an edge-binding functional unit 40 that creates a sheet bundle by stacking a predetermined number of sheets S and that performs a staple-binding process (i.e., an edge-binding process) on an edge of this sheet bundle.

Furthermore, the post-processing apparatus 2 is also provided with a saddle-stitch book-binding functional unit 30 that creates a sheet bundle by stacking a predetermined number of sheets S and that creates a booklet (i.e., performs a book-binding process) by performing a binding process (i.e., a saddle-stitching process) on a midsection of this sheet bundle.

Moreover, the folding unit 4 of the post-processing apparatus 2 is provided with a folding functional unit 50 that performs a folding process, such as an inward threefold process (i.e., a C-fold process) or an outward threefold process (i.e., a Z-fold process), on a sheet S.

Saddle-Stitch Book-Binding Functional Unit 30

Figure 3:
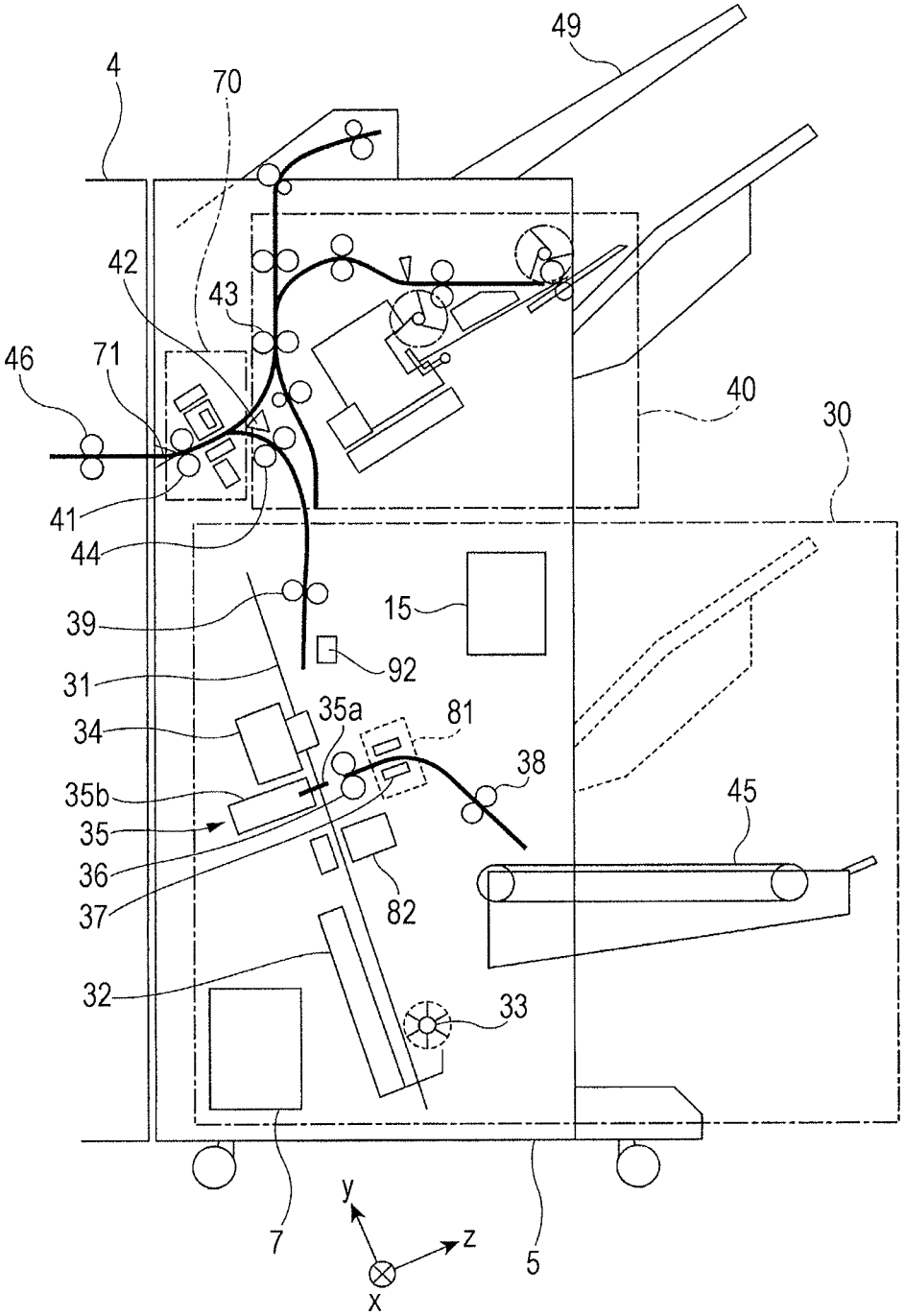
FIG. 3 illustrates the configuration of a saddle-stitch book-binding functional unit.

FIG. 3 illustrates the configuration of the saddle-stitch book-binding functional unit 30.

The saddle-stitch book-binding functional unit 30 is provided with a plate-shaped compiling member 31 that forms a sheet bundle by stacking a predetermined number of sheets S after an image forming process. The saddle-stitch book-binding functional unit 30 is also provided with a transport roller 39 that transports sheets S one-by-one to the compiling member 31. Moreover, the saddle-stitch book-binding functional unit 30 is provided with an end guide 32 that supports the sheet bundle on the compiling member 31 from below. This end guide 32 is movable along the compiling member 31.

Furthermore, the saddle-stitch book-binding functional unit 30 is provided with a sheet alignment paddle 33 that aligns the edges of the sheets S by biasing the sheets S stacked on the compiling member 31 toward the end guide 32, and a sheet-width alignment member 34 that aligns the sheets S in the width direction of the sheets S stacked on the compiling member 31. Moreover, the saddle-stitch book-binding functional unit 30 is provided with a stapler 82 that performs a binding process on the sheet bundle on the compiling member 31 by piercing a staple (not shown) therethrough.

Furthermore, the saddle-stitch book-binding functional unit 30 is provided with a folding-process mechanism 35 that performs a folding process on the sheet bundle that has undergone the binding process. This folding-process mechanism 35 is provided with a folder knife 35*a*. The folding-process mechanism 35 is also provided with an advancement mechanism 35*b* that is equipped with, for example, a motor and that causes the folder knife 35*a* to advance toward the load surface of the compiling member 31 (i.e., z-direction) from the back surface thereof.

The saddle-stitch book-binding functional unit 30 is also provided with a nipping roller 36 constituted of a pair of rollers that nip the sheet bundle for which the folding process by the folder knife 35*a* has commenced, and a pair of pressing members 37 that press against a fold section of the sheet bundle that has passed through the nipping roller 36.

In this exemplary embodiment, a section where the pair of pressing members 37 and a driving mechanism 81 (which will be described later) that drives the pair of pressing members 37 are provided may be regarded as a sheet processing apparatus that performs a pressing process on the fold section.

Furthermore, in this exemplary embodiment, an output roller 38 that outputs the sheet bundle that has been book-bound into a booklet and a booklet load section 45 onto which the sheet bundle transported by the output roller 38 is loaded are provided downstream of the pair of pressing members 37.

Moreover, the driving mechanism 81 that drives the pair of pressing members 37 and a sheet sensor 92 that detects each sheet S transported to the compiling member 31 by the transport roller 39 are also provided.

In FIG. 3, a direction in which the sheets S are transported along the load surface of the compiling member 31 is defined as a y-direction, a direction (i.e., width direction of the sheets S) orthogonal to the transport direction of the sheets S is defined as an x-direction, and a direction orthogonal to the load surface of the compiling member 31 is defined as a z-direction.

Configuration of Folding-Process Mechanism 35 and Vicinity Thereof

Figure 4:
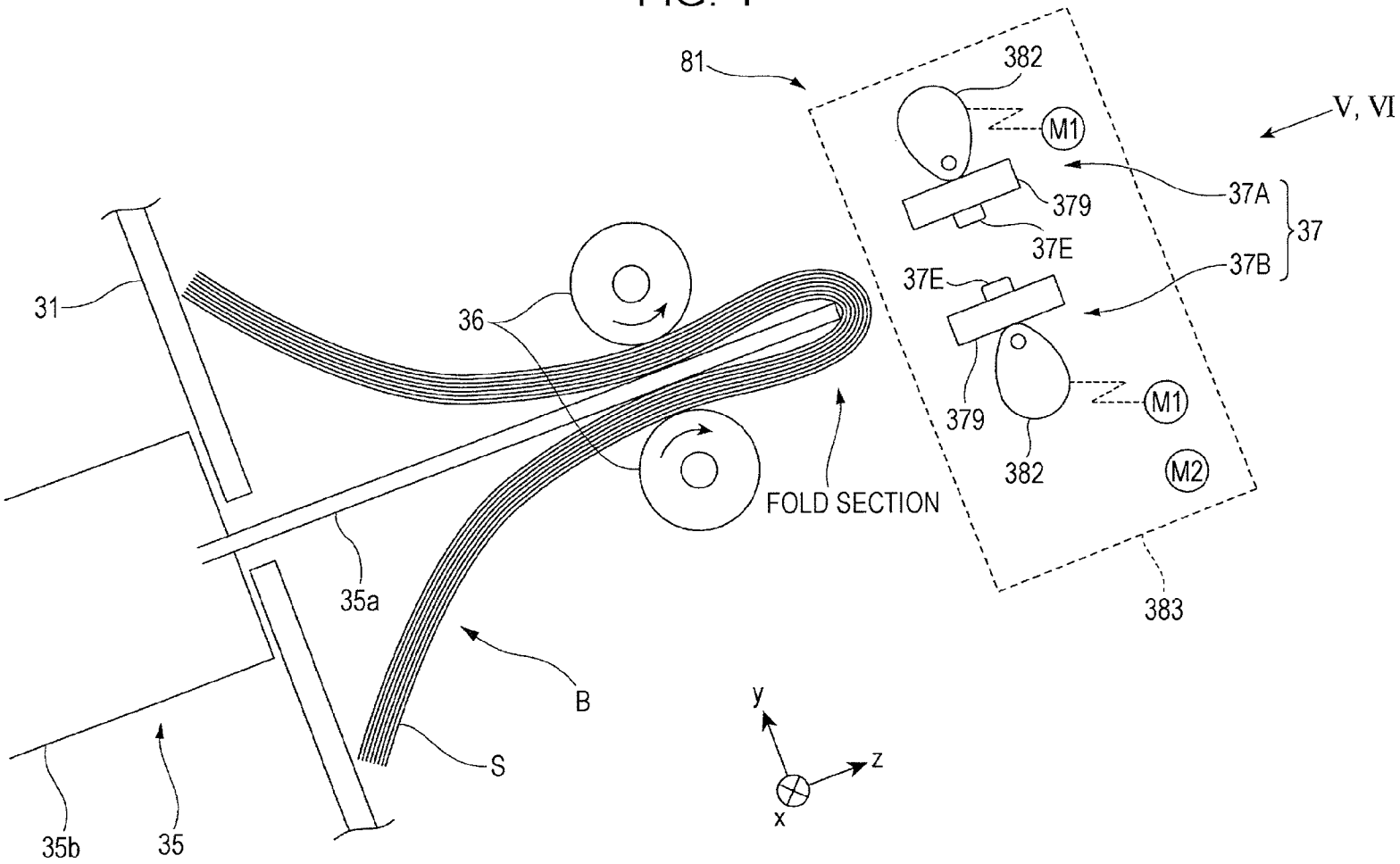
FIG. 4 illustrates the configuration of a folding-process mechanism and its vicinity.

FIG. 4 illustrates the configuration of the folding-process mechanism 35 and its vicinity.

As described above, in this exemplary embodiment, the folding-process mechanism 35 that performs a folding process on a sheet bundle B that has undergone a binding process is provided. This folding-process mechanism 35 is provided with the folder knife 35*a* and the advancement mechanism 35*b* that causes the folder knife 35*a* to advance toward the sheet bundle B.

In this exemplary embodiment, the folder knife 35*a* advances until an edge of the folder knife 35*a* reaches the nipping roller 36. Thus, a fold line is formed in the sheet bundle B, and this fold line (fold section) is pressed from opposite sides by the nipping roller 36.

In the sheet stacking stage on the compiling member 31, the saddle-stitching stage by the stapler 82 (see FIG. 3), or the sheet transport stage after the saddle-stitching process, the folder knife 35*a* is located behind the compiling member 31. Thus, interference between the sheets S and the folder knife 35*a* may be prevented.

Furthermore, in this exemplary embodiment, the pair of pressing members 37 that press against the fold section of the sheet bundle B is provided downstream of the nipping roller 36. The pair of pressing members 37 is provided with a first pressing member 37A extending in a direction orthogonal to the plane of the drawing and a second pressing member 37B similarly extending in the direction orthogonal to the plane of the drawing.

The first pressing member 37A includes a plate-shaped base 379 extending in the direction orthogonal to the plane of the drawing and a protrusion 37E protruding from one surface of the base 379 toward the second pressing member 37B. Similar to the first pressing member 37A, the second pressing member 37B is also provided with a plate-shaped base 379 and a protrusion 37E.

Furthermore, in this exemplary embodiment, the driving mechanism 81 that drives the pair of pressing members 37 is provided.

The driving mechanism 81 is provided with a spring (not shown) that biases the first pressing member 37A in a direction away from the second pressing member 37B, a cam 382 that presses the first pressing member 37A toward the second pressing member 37B, and a first motor M1 that rotates the cam 382. Likewise, the second pressing member 37B is also provided with a spring, a cam 382, and a first motor M1.

Furthermore, the driving mechanism 81 is provided with a moving mechanism 383 that moves the pair of pressing members 37 in the direction orthogonal to the plane of the drawing (i.e., a direction in which the fold section of the sheet bundle B extends as well as a direction opposite thereto).

The moving mechanism 383 may be configured based on a known technology and is constituted of, for example, a second motor M2, a pinion gear (not shown) rotated by the second motor M2, and a rack gear that operates in conjunction with the pair of pressing members 37 and that is slid by the pinion gear.

Pair of Pressing Members 37

Figure 5:
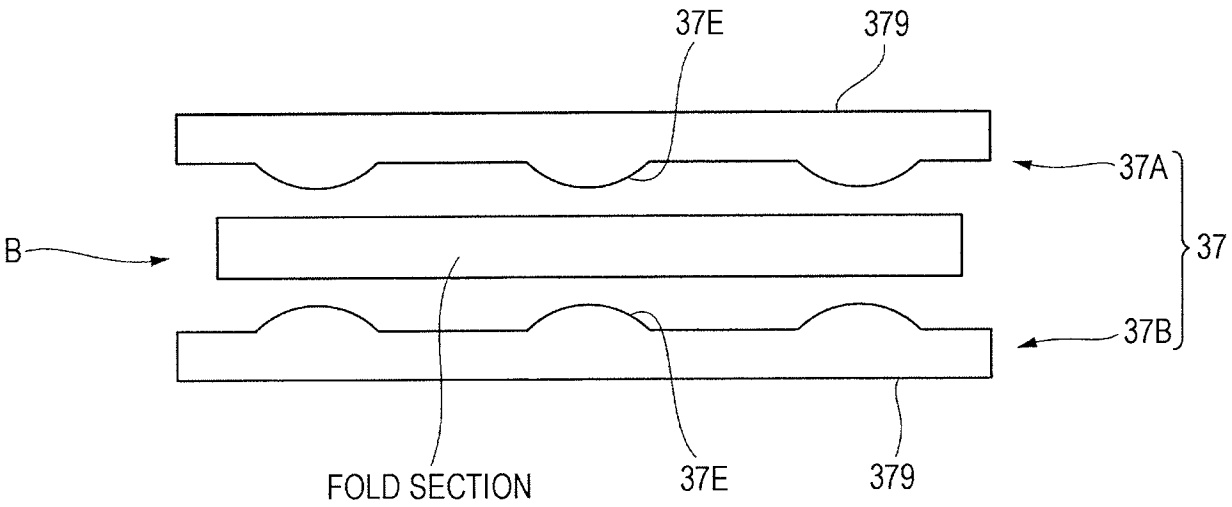
FIG. 5 illustrates a pair of pressing members as viewed from a direction indicated by an arrow V in FIG. 4.

FIG. 5 illustrates the pair of pressing members 37 as viewed from a direction indicated by an arrow V in FIG. 4.

As described above, the pair of pressing members 37 includes the first pressing member 37A and the second pressing member 37B.

The first pressing member 37A is provided with the plate-shaped base 379 and the protrusion 37E protruding from one surface of the base 379 toward the second pressing member 37B.

Likewise, the second pressing member 37B is provided with the plate-shaped base 379 and the protrusion 37E protruding from one surface of the base 379 toward the first pressing member 37A.

The first pressing member 37A and the second pressing member 37B are each disposed so as to extend in the extending direction of the fold section of the sheet bundle B. In other words, the fold section of the sheet bundle B extends in the left-right direction in FIG. 5, and the first pressing member 37A and the second pressing member 37B are disposed so as to extend also in this left-right direction.

Furthermore, each of the first pressing member 37A and the second pressing member 37B is provided with multiple protrusions 37E. Specifically, in each of the first pressing member 37A and the second pressing member 37B, multiple protrusions 37E are arranged in the extending direction of the fold section. More specifically, the multiple protrusions 37E are arranged in the longitudinal direction of each of the first pressing member 37A and the second pressing member 37B.

Moreover, in this exemplary embodiment, the protrusions 37E provided on the first pressing member 37A and the protrusions 37E provided on the second pressing member 37B face each other with the fold section interposed therebetween.

Pressing Process

FIGS. 6A to 6H illustrate the pressing process performed on the fold section by the pair of pressing members 37.

Each of FIGS. 6A to 6H illustrates a state where the pair of pressing members 37 and the sheet bundle B are viewed along an arrow VI in FIG. 4.

The pressing process by the pair of pressing members 37 is performed when the pair of pressing members 37 is driven by the driving mechanism 81. More specifically, in this exemplary embodiment, the pair of pressing members 37 is driven by the driving mechanism 81 as an example of a pressing unit so that the protrusions 37E provided on the pair of pressing members 37 are pressed against the fold section, whereby the thickness of the fold section decreases.

Figure 6G:
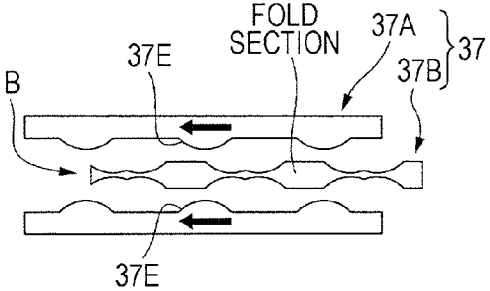
FIGS. 6A to 6H illustrate a pressing process performed on a fold section by the pair of pressing members.
Figure 6H:
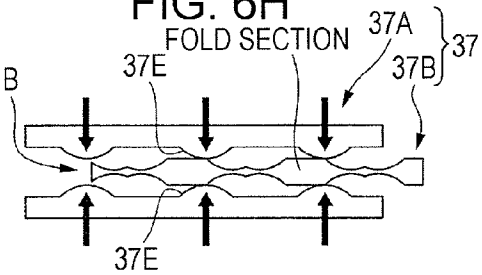
Figure 6D:
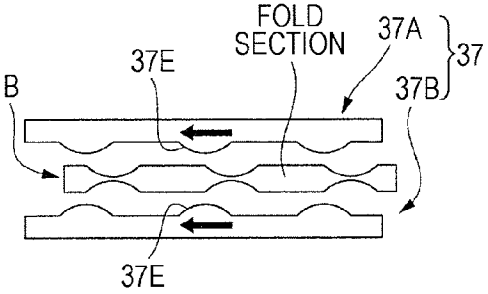

When performing the pressing process, the nipping roller 36 (see FIG. 3) first transports the sheet bundle B to the pair of pressing members 37. When the fold section of the sheet bundle B reaches the pair of pressing members 37, the nipping roller 36 temporarily stops transporting the sheet bundle B. At this time, as shown in FIG. 6A, the first pressing member 37A and the second pressing member 37B of the pair of pressing members 37 are disposed away from each other.

Figure 6E:
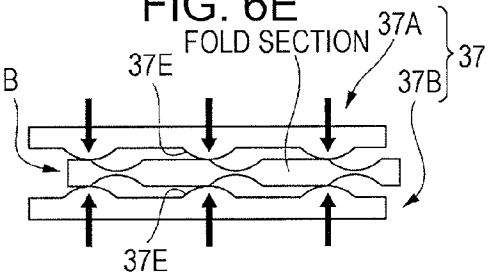
Figure 6F:
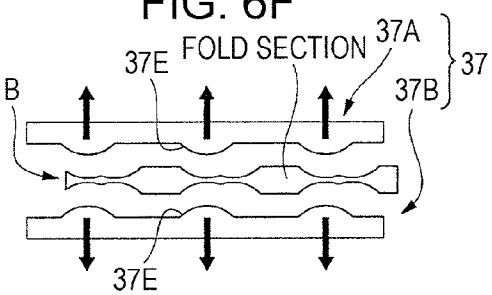
Figure 6A:
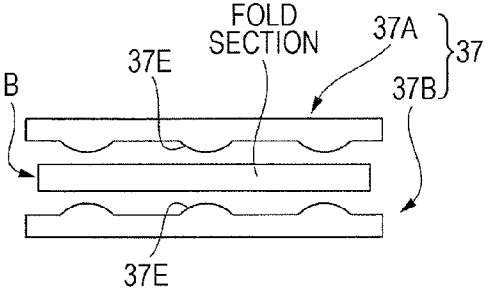
Figure 6B:
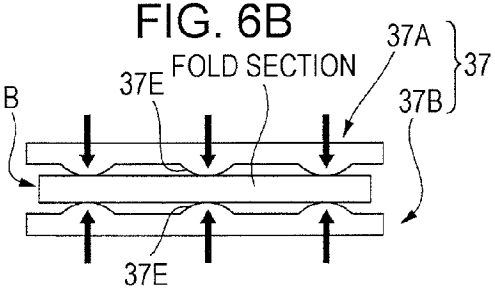

Subsequently, as shown in FIG. 6B, the first pressing member 37A and the second pressing member 37B advance toward the fold section, so that the fold section becomes pressed by the first pressing member 37A and the second pressing member 37B.

Specifically, in this exemplary embodiment, the protrusions 37E as an example of first protrusions provided on the first pressing member 37A and the protrusions 37E as an example of second protrusions provided on the second pressing member 37B face each other with the fold section interposed therebetween, and these two groups of protrusions 37E advance toward the fold section. Then, the fold section becomes nipped between these groups of protrusions 37E.

More specifically, in this exemplary embodiment, the protrusions 37E as an example of pressing protrusions provided on the first pressing member 37A are pressed against a first face of the sheet bundle B, and the protrusions 37E as an example of opposite protrusions provided on the second pressing member 37B are pressed against a second face of the sheet bundle B. Accordingly, in this exemplary embodiment, bulging of the sheet bundle B at the fold section thereof is reduced.

Figure 6C:
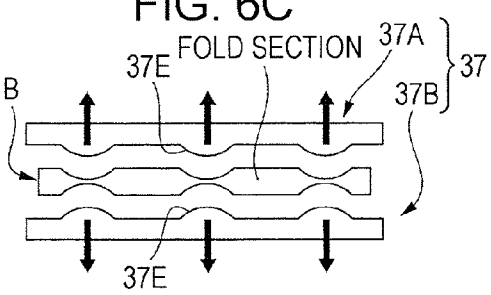

Subsequently, as shown in FIG. 6C, in this exemplary embodiment, the first pressing member 37A and the second pressing member 37B recede from the fold section. Moreover, as shown in FIG. 6D, the first pressing member 37A and the second pressing member 37B move leftward (i.e., in one extending direction of the fold section) by a predetermined distance.

In this case, the first pressing member 37A and the second pressing member 37B are moved by the driving mechanism 81, and the driving mechanism 81 may be regarded as a shifting unit that shifts the pressing position at which the fold section is pressed by the protrusions 37E.

Subsequently, as shown in FIG. 6E, the first pressing member 37A and the second pressing member 37B move toward each other so that the fold section is pressed again by the first pressing member 37A and the second pressing member 37B (second pressing step).

In the state shown in FIG. 6E, the positions of the protrusions 37E provided on the first pressing member 37A and the second pressing member 37B are different from the positions thereof in the previous pressing step (i.e., the first pressing step, see FIG. 6B). In other words, the pressing positions in the extending direction of the fold section are different between the first pressing step and the second pressing step.

Subsequently, as shown in FIG. 6F, in this exemplary embodiment, the first pressing member 37A and the second pressing member 37B recede again from the fold section. Moreover, as shown in FIG. 6G, the first pressing member 37A and the second pressing member 37B move leftward.

Then, as shown in FIG. 6H, the first pressing member 37A and the second pressing member 37B advance again toward the fold section of the sheet bundle B so that the fold section is pressed again by the first pressing member 37A and the second pressing member 37B (third pressing step).

In this exemplary embodiment, when these pressing steps are completed, the fold section has undergone the pressing process entirely in the longitudinal direction thereof.

Subsequently, in this exemplary embodiment, the nipping roller 36 (see FIG. 3) rotates so as to move the sheet bundle B downstream. The sheet bundle B then reaches the output roller 38 (see FIG. 3) and is subsequently transported to the booklet load section 45.

In the configuration according to this exemplary embodiment, bulging of the sheet bundle B may be suppressed while an increase in size of the apparatus may be suppressed. Such bulging of the sheet bundle B may be suppressed also by, for example, using the outer peripheral surfaces of cylindrical roller members to nip the fold section from opposite sides of the sheet bundle B. In this case, since the fold section becomes pressed by a wide area in the longitudinal direction of the roller members (i.e., since the pressing area increases due to the fold section being pressed by planar portions), the pressing load per unit area tends to decrease.

In order to suppress a decrease in this pressing load, for example, the spring load applied for pressing has to be increased. In this case, the strength of, for example, a frame is increased. This tends to lead to an increase in size of the apparatus.

In contrast, in the configuration according to this exemplary embodiment, the sheet bundle B is pressed by using the protrusions 37E, so that the pressing load may be concentrated on specific locations of the fold section, whereby the fold section may be pressed even with small spring load. In this case, the aforementioned frame with increased strength may be omitted.

Furthermore, in the configuration according to this exemplary embodiment, bulging of the sheet bundle B may be suppressed while the occurrence of fold wrinkles at the fold section of the sheet bundle B may be suppressed. Such bulging of the sheet bundle B may be suppressed also by, for example, nipping the fold section using a fold-enhancing roller that further applies pressure onto the fold section. In this case, the fold-enhancing roller moves along the fold section while pressing against an extremely narrow area of the fold section and concentrating on a single location thereof so as to rapidly and firmly press down on the fold section. This tends to cause fold wrinkles to occur at the fold section of the sheet bundle B.

In order to suppress this occurrence of fold wrinkles, for example, deformation of the sheet bundle B has to be reduced at the time of the pressing process. In this case, for example, the spring load applied for pressing has to be reduced. This tends to lower the effect of suppressing bulging of the sheet bundle B.

In contrast, in the configuration according to this exemplary embodiment, since bulging of the sheet bundle B is suppressed to some extent by applying load thereto from directly above even at locations other than the protrusions 37E, the occurrence of fold wrinkles at the fold section may be suppressed even by concentrating the pressing load to specific locations of the fold section. In this case, the load may be increased up to the limit of the strength of the frame and the rollers.

Figure 7:
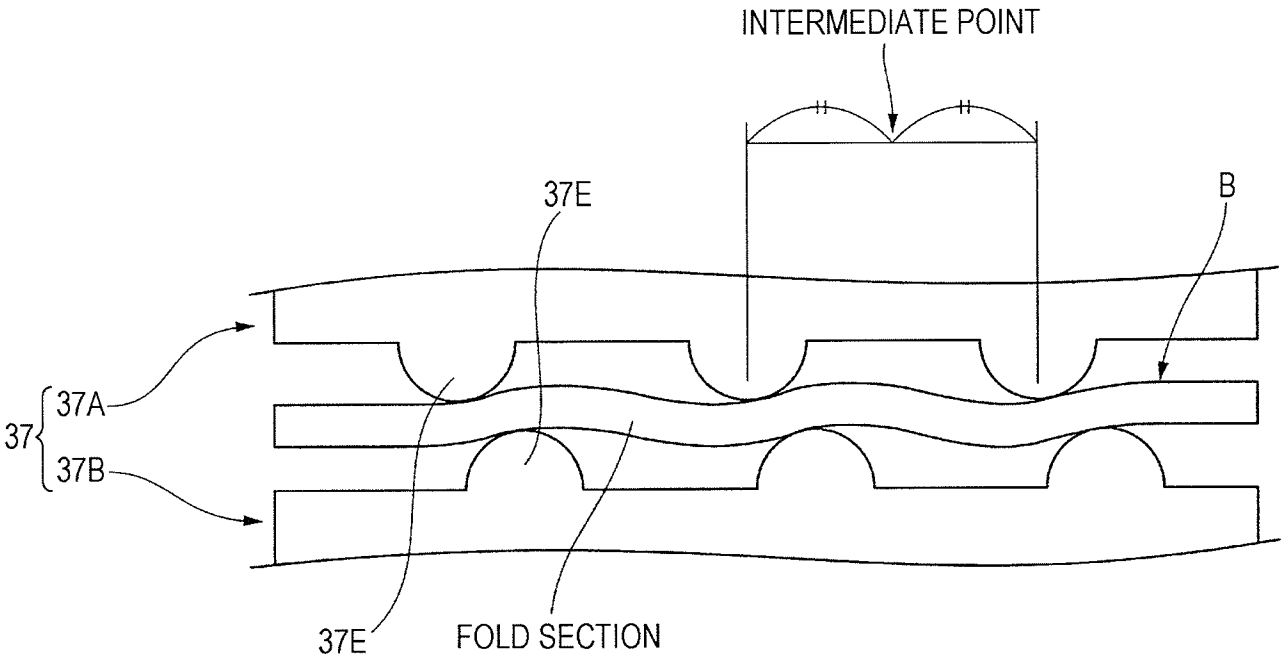
FIG. 7 illustrates another configuration example of the pair of pressing members.

FIG. 7 illustrates another configuration example of the pair of pressing members 37.

In this configuration example, the positions of the protrusions 37E of the first pressing member 37A and the positions of the protrusions 37E of the second pressing member 37B are displaced relative to each other in the longitudinal direction of the pair of pressing members 37 (i.e., in the extending direction of the fold section).

In other words, in this configuration example, the pressing positions where the protrusions 37E provided on the first pressing member 37A press against the fold section and the pressing positions where the protrusions 37E provided on the second pressing member 37B press against the fold section are displaced relative to each other in the extending direction of the fold section.

In this case, the fold section becomes firmly pressed, so that the sheet bundle B becomes less likely to bulge again upon completion of the pressing process, as compared with the above configuration (i.e., the configuration shown in FIGS. 5 to 6H) in which the fold section is pressed by the two opposing groups of protrusions 37E.

More specifically, in the configuration shown in FIG. 7, each protrusion 37E of the second pressing member 37B advances toward a space located between two protrusions 37E, which are adjacent to each other in the longitudinal direction of the first pressing member 37A, of the multiple protrusions 37E provided on the first pressing member 37A. Moreover, in this configuration example, each protrusion 37E of the second pressing member 37B is positioned leftward (i.e., toward one of the aforementioned two adjacent protrusions 37E) relative to an intermediate point between the aforementioned two adjacent protrusions 37E.

Although each protrusion 37E of the second pressing member 37B is positioned leftward relative to the intermediate point in FIG. 7, if the aforementioned two protrusions 37E are separated from each other by a small distance, a configuration in which each protrusion 37E of the second pressing member 37B advances toward the intermediate point between these two protrusions 37E is also conceivable.

Another processing example by the pair of pressing members 37 will be described below.

In this exemplary embodiment, multiple pressed locations occur in the fold section every time the pair of pressing members 37 presses against the fold section. Alternatively, when a new pressing step is to be performed by using the protrusions 37E, the intermediate points between the pressed locations that have occurred in the previous pressing step may be pressed.

Figure 8A:
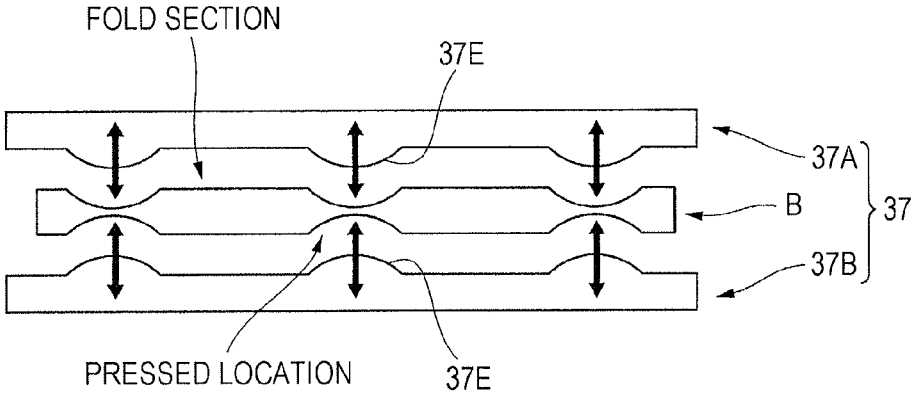
FIGS. 8A, 8B, and 8C illustrate another processing example by the pair of pressing members.

This will be described in detail with reference to FIGS. 8A to 8C (which illustrate this processing example by the pair of pressing members 37). First, as shown in FIG. 8A, in this exemplary embodiment, multiple pressed locations occur in the fold section of the sheet bundle B as a result of a first pressing step.

Figure 8B:
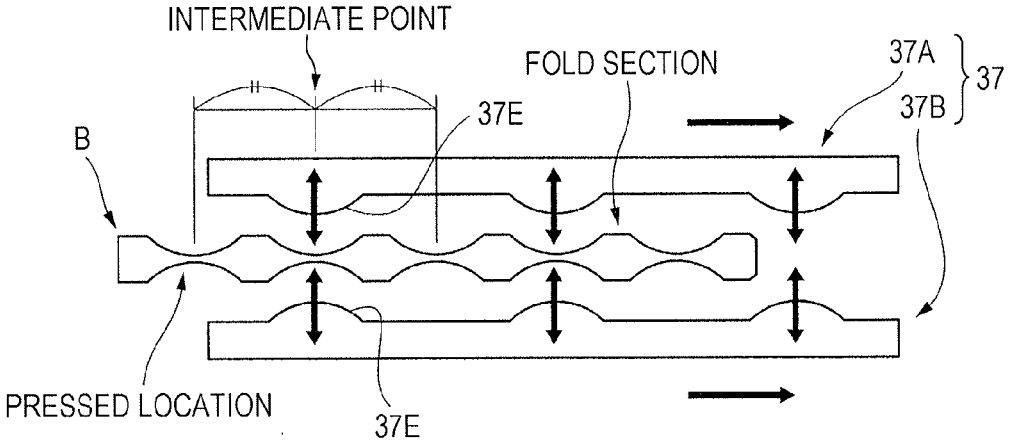

Subsequently, as shown in FIG. 8B, in this processing example, a second pressing step is performed by moving the pair of pressing members 37 such that each protrusion 37E faces the intermediate point between two adjacent pressed locations of the multiple pressed locations.

Figure 8C:
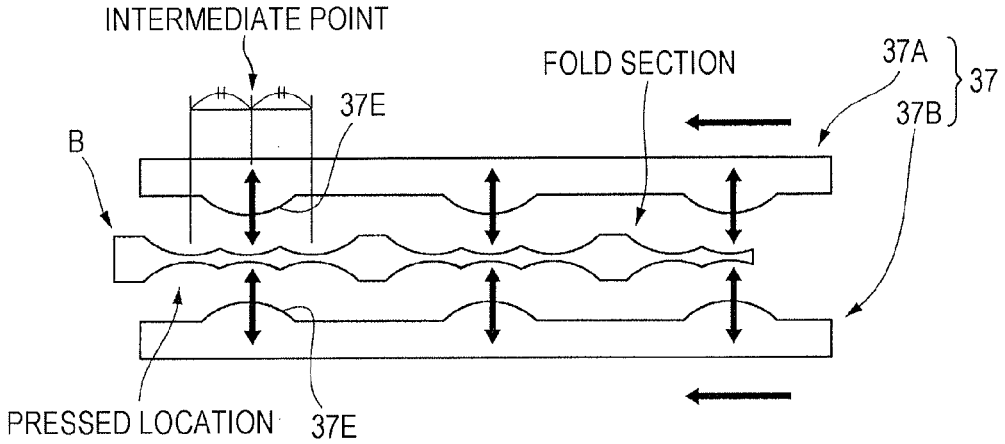

Then, as shown in FIG. 8C, in this exemplary embodiment, the pair of pressing members 37 is moved such that the protrusions 37E are positioned at the intermediate points between the pressed locations occurring as a result of the first pressing step and the pressed locations occurring as a result of the second pressing step. In this state, a third pressing step is performed.

Figure 9:
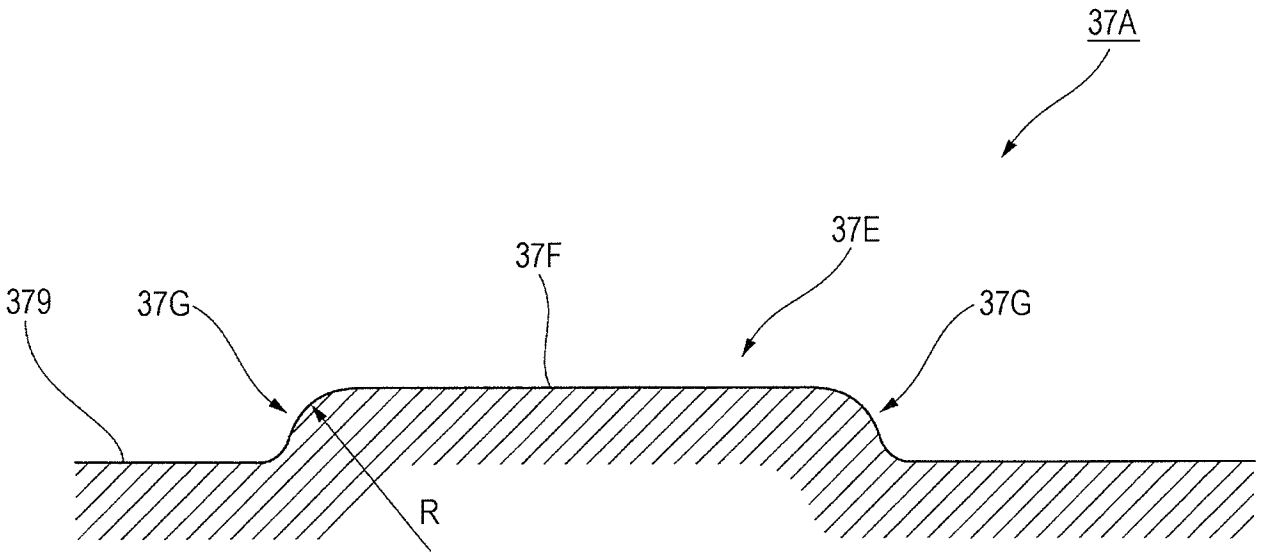
FIG. 9 illustrates another configuration example of each protrusion provided on a first pressing member.

FIG. 9 illustrates another configuration example of each protrusion 37E provided on the first pressing member 37A. Although the first pressing member 37A will be described here, the second pressing member 37B has a configuration similar to that of the first pressing member 37A.

In the above description, dome-shaped protrusions 37E each having curvature in its entirety have been described as an example. This shape is only an example, and each protrusion 37E may be formed as shown in FIG. 9.

The protrusion 37E shown in FIG. 9 is provided with a flat surface 37F at the top of the protrusion 37E. This flat surface 37F is disposed parallel to the surface of the base 379 provided in the first pressing member 37A. Moreover, the protrusion 37E is provided with side portions 37G, and each of these side portions 37G is given curvature such that the side portion 37G bulges outward.

Although the above description relates to a configuration example in which multiple protrusions 37E are provided on each of the first pressing member 37A and the second pressing member 37B, only a single protrusion 37E may be provided on each of the first pressing member 37A and the second pressing member 37B.

Furthermore, although the above description relates to a configuration in which both the first pressing member 37A and the second pressing member 37B move toward and away from the fold section, only one of the first pressing member 37A and the second pressing member 37B may be configured to move toward and away from the fold section.

Moreover, although the first pressing member 37A and the second pressing member 37B are moved every time the fold section is pressed by the first pressing member 37A and the second pressing member 37B in the above description, the first pressing member 37A and the second pressing member 37B may be moved after pressing against the fold section multiple times at one location.

Furthermore, the pressing process performed by using the first pressing member 37A and the second pressing member 37B may be performed by sequentially moving the first pressing member 37A and the second pressing member 37B in one direction, as shown in FIGS. 6A to 6H, or may be performed by moving the first pressing member 37A and the second pressing member 37B in the opposite direction in addition to the one direction, as shown in FIGS. 8A to 8C.

Furthermore, although two pressing members, namely, the first pressing member 37A and the second pressing member 37B, are provided in the above description, for example, the first pressing member 37A alone may be provided, and a support base that supports the sheet bundle B from below may be provided at the second pressing member 37B side.

Moreover, although the above description relates to an example of a configuration in which the pair of pressing members 37 advances toward the fold section, for example, the fold section may be pressed by the protrusions 37E provided on the first pressing member 37A by moving the sheet bundle B upward (e.g., by lifting the sheet bundle B from below by using, for example, the aforementioned support base).

Furthermore, although the pressing positions for the fold section are sequentially shifted by moving the pair of pressing members 37 in the extending direction of the fold section in the above description, the pressing positions for the fold section may be shifted by moving the sheet bundle B in the extending direction of the fold section. Moreover, the pressing positions for the fold section may be shifted by moving both the pair of pressing members 37 and the sheet bundle B.

Figure 10A:
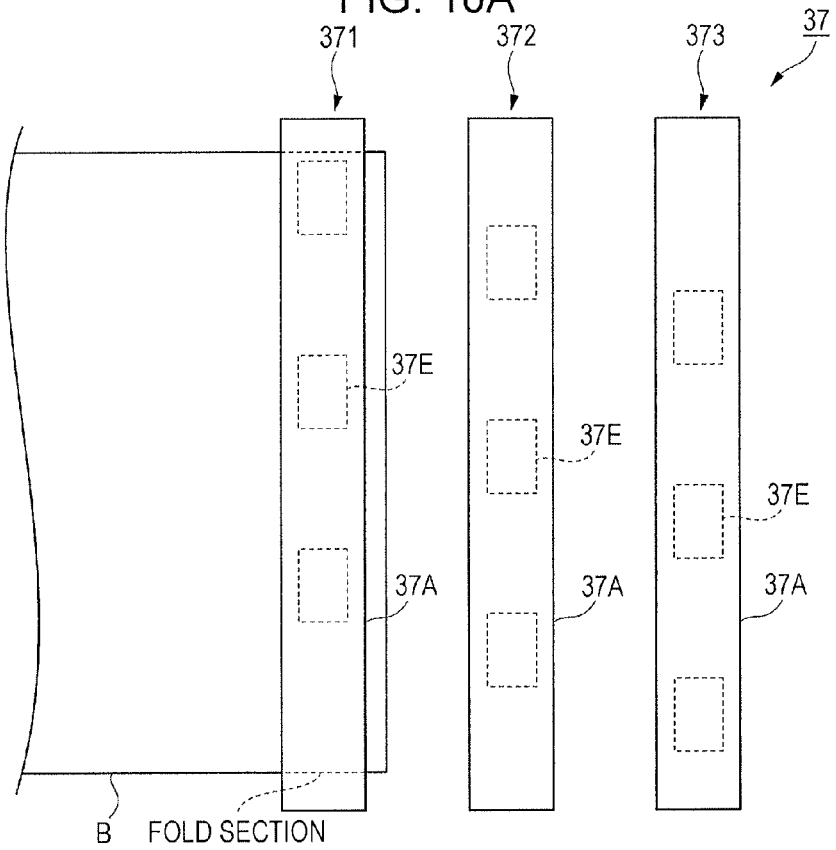
FIGS. 10A and 10B illustrate another configuration example of the pair of pressing members.
Figure 10B:
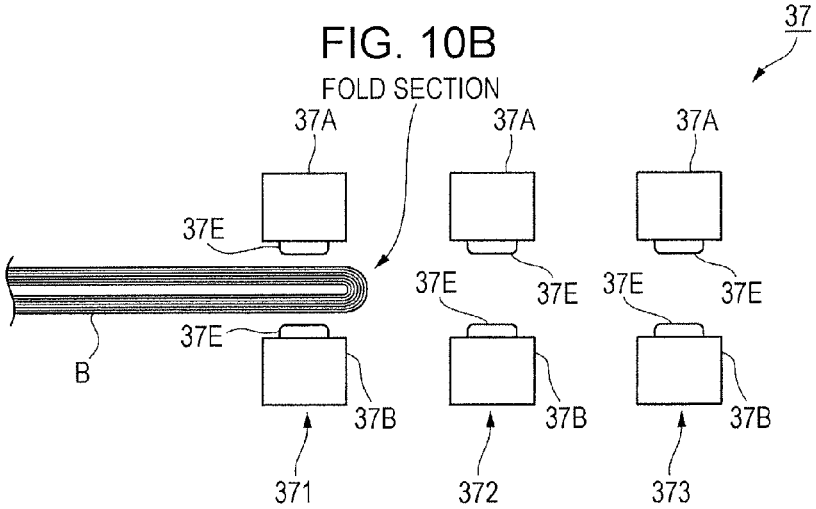

FIGS. 10A and 10B illustrate another configuration example of the pair of pressing members 37. Specifically, FIG. 10A is a top view of the pair of pressing members 37 and so on, and FIG. 10B is a side view of the pair of pressing members 37 and so on.

In this configuration example, multiple pairs of pressing members 37 are provided. Specifically, as shown in FIGS. 10A and 10B, three pairs of pressing members 37, namely, a first pair of pressing members 371, a second pair of pressing members 372, and a third pair of pressing members 373, are provided.

The first pair of pressing members 371 to the third pair of pressing members 373 are arranged in the transport direction of the sheet bundle B. In other words, the first pair of pressing members 371 to the third pair of pressing members 373 are arranged in the direction orthogonal to (intersecting) the extending direction of the fold section of the sheet bundle B. Furthermore, as shown in FIG. 10B, each of the first pair of pressing members 371 to the third pair of pressing members 373 is provided with the first pressing member 37A and the second pressing member 37B. In addition, as shown in FIGS. 10A and 10B, similar to the above description, each of the first pressing member 37A and the second pressing member 37B is provided with the protrusions 37E.

Furthermore, as shown in FIG. 10A, in this exemplary embodiment, the set positions of the protrusions 37E in the extending direction of the fold section vary from pair of pressing members to pair of pressing members.

Specifically, the protrusions 37E are disposed toward the upper side of FIG. 10A in the first pair of pressing members 371, whereas the protrusions 37E are disposed toward the lower side of FIG. 10A in the third pair of pressing members 373. In the second pair of pressing members 372, the protrusions 37E are disposed at intermediate positions in the up-down direction.

More specifically, the first pair of pressing members 371 to the third pair of pressing members 373 are arranged in the direction intersecting one direction in which the fold section extends, so that the first pressing member 37A and the second pressing member 37B included in each pair of pressing members are also arranged in the direction intersecting the aforementioned extending direction of the fold section.

As will be described below, in this exemplary embodiment, the first pressing members 37A and the second pressing members 37B included in the first pair of pressing members 371 and the third pair of pressing members 373 sequentially advance toward the fold section. Thus, similar to the above description, the pressing process is performed while the pressing positions for the fold section are shifted. In other words, in this exemplary embodiment, the first pressing members 37A and the second pressing members 37B as an example of pressing members are pressed against the fold section of the sheet bundle B so as to reduce the thickness of the fold section of the sheet bundle B.

FIGS. 11A to 11E illustrate the flow of a pressing process in accordance with the configuration example shown in FIGS. 10A and 10B. FIGS. 11A to 11E are side views of the first pair of pressing members 371 to the third pair of pressing members 373 and the sheet bundle B.

Figure 11A:
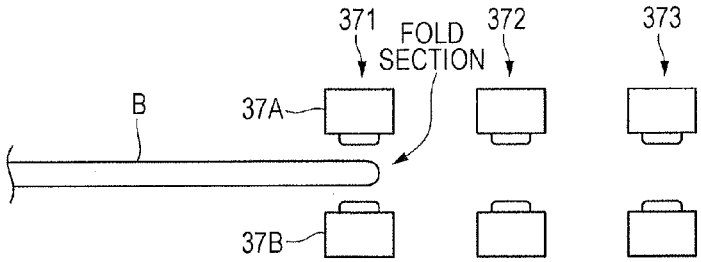
FIGS. 11A to 11E illustrate the flow of a pressing process in accordance with the configuration example shown in FIGS. 10A and 10B.

Similar to the above description, in this process, the nipping roller 36 (see FIG. 3) first transports the sheet bundle B to the first pair of pressing members 371 so that the fold section of the sheet bundle B reaches the first pair of pressing members 371. At this time, as shown in FIG. 11A, the first pressing member 37A and the second pressing member 37B of the first pair of pressing members 371 are disposed away from each other.

Figure 11B:
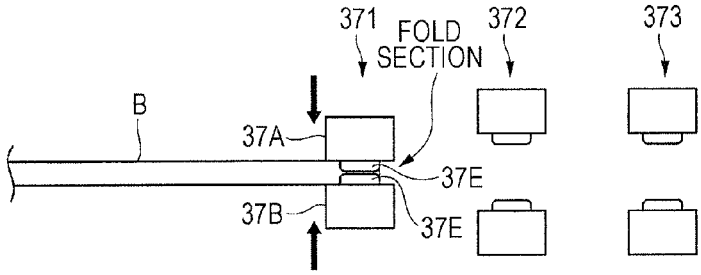

Subsequently, as shown in FIG. 11B, the first pressing member 37A and the second pressing member 37B provided in the first pair of pressing members 371 advance toward the fold section, so that the fold section becomes pressed by the first pressing member 37A and the second pressing member 37B.

Specifically, the fold section becomes nipped between the protrusions 37E provided on the first pressing member 37A and the protrusions 37E provided on the second pressing member 37B, whereby the fold section becomes pressed by these two groups of protrusions 37E.

Figure 11C:
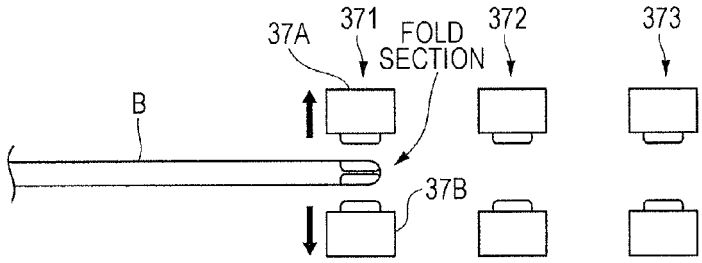
Figure 11D:
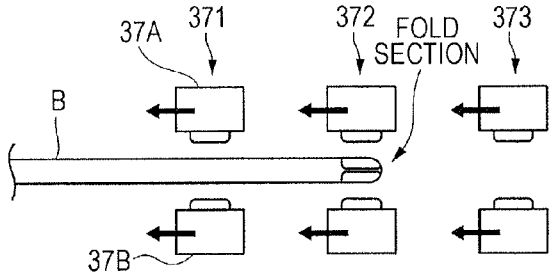
Figure 11E:
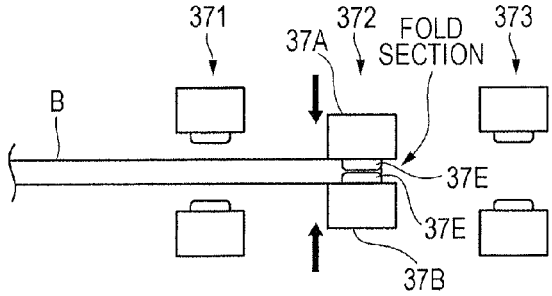

Subsequently, as shown in FIG. 11C, the first pressing member 37A and the second pressing member 37B provided in the first pair of pressing members 371 recede from the fold section. Then, as shown in FIG. 11D, the second pair of pressing members 372 moves to the fold section. The fold section then becomes pressed by the first pressing member 37A and the second pressing member 37B provided in the second pair of pressing members 372, as shown in FIG. 11E.

Subsequently, similar operation is performed, such that the third pair of pressing members 373 moves to the fold section, and the fold section becomes pressed by the first pressing member 37A and the second pressing member 37B provided in the third pair of pressing members 373.

Then, similar to the above description, the nipping roller 36 (see FIG. 3) rotates so as to move the sheet bundle B downstream. The sheet bundle B then reaches the output roller 38 (see FIG. 3) and is subsequently transported to the booklet load section 45.

Similar to the above description, the advancing and receding of the first pressing member 37A and the second pressing member 37B provided in each of the first pair of pressing members 371 to the third pair of pressing members 373 toward and away from the fold section may be performed by using springs and cams. Furthermore, similar to the above description, the first pair of pressing members 371 to the third pair of pressing members 373 may be moved leftward in FIGS. 11A to 11E (i.e., in the direction orthogonal to the extending direction of the fold section) by using, for example, motors, pinion gears, and rack gears.

As an alternative to this example in which the first pair of pressing members 371 to the third pair of pressing members 373 are moved, the sheet bundle B may be moved or both the first pair of pressing members 371 to the third pair of pressing members 373 and the sheet bundle B may be moved.

Furthermore, in each of the first pair of pressing members 371 to the third pair of pressing members 373, the protrusions 37E may be made to face each other, as in FIG. 5, or the protrusions 37E of the first pressing member 37A and the protrusions 37E of the second pressing member 37B may be displaced relative to each other, as in FIG. 7.

Furthermore, although the pressed locations by the protrusions 37E are sequentially shifted in one direction in the configuration example shown in FIGS. 10A to 11E, an intermediate point between two pressed locations may be pressed, as shown in FIGS. 8A to 8C, by adjusting the set positions of the protrusions 37E in each pair of pressing members.

Moreover, although the set positions of the protrusions 37E (i.e., the set positions in the longitudinal direction of each pair of pressing members) vary from pair of pressing members to pair of pressing members in the configuration example shown in FIGS. 10A to 11E, one or some of the protrusions 37E may be disposed at identical locations (i.e., identical locations in the longitudinal direction of each pair of pressing members) among the pairs of pressing members. In this case, the same location of the fold section becomes pressed two or more times, so that, for example, a location where pressing is desirably performed thereon in particular may be pressed two or more times.

In the configuration example shown in FIGS. 10A to 11E, since the pairs of pressing members are not moved in the extending direction of the fold section, the apparatus may be readily reduced in size in the extending direction of the fold section, as compared with the above configuration in, for example, FIG. 5 in which the pair of pressing members 37 is moved.

Figure 12:
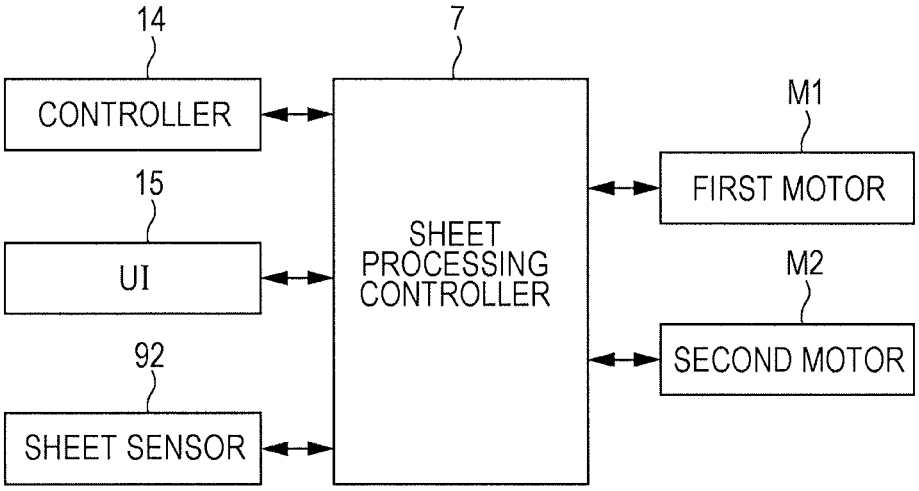
FIG. 12 is a functional block diagram of a sheet processing controller.

FIG. 12 is a functional block diagram of the sheet processing controller 7.

The sheet processing controller 7 according to this exemplary embodiment receives information about a process (i.e., a folding process) to be performed on a sheet bundle B from the controller 14 of the image forming apparatus 1. Moreover, the sheet processing controller 7 receives a signal indicating, for example, a processing condition received via the user interface (UI) 15. Furthermore, the sheet processing controller 7 receives a detection signal, which indicates that a sheet S has been detected, from the sheet sensor 92. Moreover, the sheet processing controller 7 outputs control signals to the first motors M1 and the second motors M2 for rotating the aforementioned pinion gears and the cams 382 (see FIG. 4).

The sheet processing controller 7 includes a central processing unit (CPU), a read-only memory (ROM), a random access memory (RAM), and a hard disk drive (HDD), which are not shown. The CPU executes a processing program. The ROM stores therein, for example, various kinds of programs, various kinds of tables, and parameters. The RAM is used as, for example, a work area when the CPU executes various kinds of programs.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A sheet processing apparatus comprising:

a pressing unit comprising a protrusion and that is configured to press the protrusion against a fold section of a sheet, the fold section extending in one direction; and a shifting unit configured to move at least one of the protrusion of the pressing unit and the sheet so as to shift a pressing position, at which the fold section is pressed by the protrusion, in the one direction or in a direction opposite to the one direction, wherein the pressing unit comprises a first pressing member comprising a first plate-shaped base, wherein the protrusion protrudes from a surface of the first plate-shaped base, and wherein the pressing unit is configured to apply a load to the fold section from directly above the fold section to suppress occurrence of fold wrinkles at the fold section.

2. The sheet processing apparatus according to claim 1, wherein the shifting unit is configured to shift the pressing position by moving the protrusion in the one direction or in the direction opposite to the one direction.

3. The sheet processing apparatus according to claim 1, wherein the first pressing member includes a plurality of protrusions arranged in the one direction.

4. The sheet processing apparatus according to claim 1, further comprising:

a plurality of pressing members each having the protrusion, the plurality of pressing members being arranged in a direction intersecting the one direction, wherein the protrusions of the plurality of pressing members are configured to be pressed against the fold section, wherein set positions of the protrusions in the one direction are different from pressing member to pressing member, and wherein the shifting unit is configured to cause each pressing member included in the plurality of pressing members to sequentially advance toward the fold section so as to shift the pressing position.

5. The sheet processing apparatus according to claim 1, further comprising:

an opposite protrusion that is provided opposite the protrusion, wherein the opposite protrusion is configured to be pressed against the fold section from a side opposite to a side provided with the protrusion, and wherein the sheet processing apparatus is configured to have a pressing position at which a pressing protrusion serving as the protrusion included in the pressing unit presses against the fold section and a pressing position at which the opposite protrusion presses against the fold section be displaced relative to each other.

6. An image forming system comprising:

an image forming apparatus configured to form an image onto a sheet;

a folding-process mechanism configured to perform a folding process on the sheet having the image formed thereon by the image forming apparatus; and a sheet processing apparatus configured to perform a pressing process on a fold section of the sheet that has undergone the folding process performed by the folding-process mechanism, wherein the sheet processing apparatus comprises the sheet processing apparatus according to claim 1.

7. The sheet processing apparatus according to claim 1, wherein the pressing unit further comprises a second pressing member, and wherein the protrusion protrudes toward the second pressing member.

8. The sheet processing apparatus according to claim 7, wherein the second pressing member comprises an opposite protrusion that is provided opposite the protrusion, and wherein the protrusion and the opposite protrusion are configured to nip the fold section.

9. The sheet processing apparatus according to claim 1, wherein the pressing unit is configured to apply the load to the fold section from directly above the fold section even at locations other than the protrusion.

10. A sheet processing apparatus comprising:

a pressing unit comprising a protrusion and that is configured to press the protrusion against a fold section of a sheet, the fold section extending in one direction;

a shifting unit configured to move at least one of the protrusion of the pressing unit and the sheet so as to shift a pressing position, at which the fold section is pressed by the protrusion, in the one direction or in a direction opposite to the one direction; and an opposite protrusion that is provided opposite the protrusion, wherein the opposite protrusion is configured to be pressed against the fold section from a side opposite to a side provided with the protrusion, wherein the sheet processing apparatus is configured to have a pressing protrusion serving as the protrusion included in the pressing unit and the opposite protrusion face each other with the fold section interposed therebetween, and wherein the pressing protrusion and the opposite protrusion are configured to nip the fold section.

11. A sheet processing apparatus comprising:

a pressing unit comprising a protrusion and that is configured to press the protrusion against a fold section of a sheet, the fold section extending in one direction; and a shifting unit configured to move at least one of the protrusion of the pressing unit and the sheet so as to shift a pressing position, at which the fold section is pressed by the protrusion, in the one direction or in a direction opposite to the one direction, wherein the pressing unit comprises a first pressing member comprising a first plate-shaped base, wherein the protrusion protrudes from a surface of the first plate-shaped base, wherein the sheet processing apparatus further comprises:

a plurality of pressing members each having the protrusion, the plurality of pressing members being arranged in a direction intersecting the one direction, wherein the protrusions of the plurality of pressing members are configured to be pressed against the fold section, wherein set positions of the protrusions in the one direction are different from pressing member to pressing member, and wherein the shifting unit is configured to cause each pressing member included in the plurality of pressing members to sequentially advance toward the fold section so as to shift the pressing position.

12. A sheet processing apparatus comprising:

a pressing unit comprising a protrusion and that is configured to press the protrusion against a fold section of a sheet, the fold section extending in one direction; and a shifting unit configured to move at least one of the protrusion of the pressing unit and the sheet so as to shift a pressing position, at which the fold section is pressed by the protrusion, in the one direction or in a direction opposite to the one direction, wherein the pressing unit comprises a first pressing member comprising a first plate-shaped base, wherein the protrusion protrudes from a surface of the first plate-shaped base, wherein the pressing unit further comprises a second pressing member, wherein the protrusion protrudes toward the second pressing member, wherein the second pressing member comprises an opposite protrusion that is provided opposite the protrusion, and wherein the protrusion and the opposite protrusion are configured to nip the fold section.

* * * * *